US005353045A

United States Patent [19]

Sako

[11] Patent Number: 5,353,045

[45] Date of Patent: Oct. 4, 1994

[54] THERMAL PRINTHEAD

[75] Inventor: Teruhisa Sako, Kyoto, Japan

[73] Assignee: Rohm Co., Ltd., Kyoto, Japan

[21] Appl. No.: 18,374

[22] Filed: Feb. 16, 1993

[30] Foreign Application Priority Data

Feb. 17, 1992 [JP] Japan ..... 4-029269

[51] Int. Cl.[5] ..... B41J 2/335

[52] U.S. Cl. ..... 346/76 PH

[58] Field of Search ..... 346/76 PH; 400/120

[56] References Cited

U.S. PATENT DOCUMENTS 4,963,886 10/1990 Fukuda et al. ..... 346/76 PH
4,972,205 11/1990 Nagato ..... 346/76 PH
5,173,718 12/1992 Takayama et al. ..... 346/76 PH

FOREIGN PATENT DOCUMENTS 0083419 7/1983 European Pat. Off. .
3940545 6/1990 Fed. Rep. of Germany .
60-192689 10/1985 Japan .
0229052 9/1990 Japan ..... 346/76 PH

*Primary Examiner*—Benjamin R. Fuller
*Assistant Examiner*—Huan Tran
*Attorney, Agent, or Firm*—William H. Eilberg

[57] ABSTRACT

A thermal printhead comprises a support plate, a head substrate mounted on the support plate, a connector board reinforced by a backing member which rests on the support plate, and a presser member overlapped on the connector board. The connector board has a marginal portion projecting beyond the backing member. The presser member is pressed by screws for pressing the marginal portion of the connector board into contact with the head substrate. The backing member is made of a material having a glass transition point of not less than 150° C.

6 Claims, 5 Drawing Sheets

THERMAL PRINTHEAD

BACKGROUND OF THE INVENTION

1. Field of the Invention

This invention relates to a thermal printhead which is used to print on thermosensitive paper or to cause ink transfer from a thermal transfer ribbon or film onto printing paper for example.

2. Description of the Prior Art

As is well known, thermal printheads are widely used in facsimile machines to print transmitted information on thermosensitive paper. The thermal printhead is also used in printers of the type wherein the ink of a transfer ink ribbon or film is thermally caused to be transferred onto printing paper.

For conveniently explaining the problems to be solved by the present invention, reference is now made to FIG. 7 of the accompanying drawings which shows a typical prior art thermal printhead. A similar printhead is also disclosed in U.S. Pat. No. 4,963,886 to Fukuda et al.

As shown in FIG. 7, the prior art thermal printhead 1' mainly comprises a support plate 2', a head substrate 3', a connector board 4', and a presser member 5'.

The support plate 2' is made of a metal such aluminum. The support plate functions to dissipate the heat generated at the head substrate 3' in addition to supporting it.

The head substrate 3', which is made of an insulating material such as ceramic (e.g. alumina), is elongate and adhesively bonded to the support plate 2'. The head substrate is formed with a heating resistor line 6' extending adjacent to and along one longitudinal edge of the substrate. The substrate carries a longitudinal array of drive ICs 7' (only one shown) for selectively actuating divided dot portions of the resistor line 6'. The head substrate is further formed with comb-like connection terminals 8' (details not shown) adjacent to the other longitudinal edge of the head substrate, and a wiring conductor pattern (not shown) for connecting between the drive ICs and the connection terminals.

The connector board 4' is made of an insulating material such as a polyimide film. The connector board 4' is reinforced by a backing member 10' and has a marginal portion **4*a'* projecting beyond the backing member 10' to overlap the head substrate 3'. The underside of the marginal portion 4*a'* is formed with comb-like connection terminals 9' (details not shown) in corresponding relation to the connection terminals 8'** of the head substrate.

The presser member 5', which is made of a metal such as aluminum, has an anchoring base portion **5*a'*, an intermediate presser portion 5*b'*, and a cover portion 5*c'*. The anchoring portion 5*a'* is fixed on the connector board 4' by means of screws 12' (only one shown). The presser portion 5*b'* is provided with an elastic rod 11' made of rubber for example for pressing the marginal portion 4*a'* of the connector board 4' into intimate contact with the head substrate 3', thereby establishing electrical connection between the two kinds of connection terminals 8', 9'. The cover portion 5*c'* is located above the array of drive ICs 7'** for protection.

For enabling the mounting of the presser member 5', the anchoring base portion **5*a'* is formed with perforations 13' (only one shown) for allowing penetration of the respective screws 12'. Similarly, the connector board 4' together with its backing member 10' is also formed with perforations 14' in corresponding relation to the respective perforations 13' of the presser member 5'. Further, the support plate 2' is formed with threaded holes 14' for engagement with the respective screws 12'**.

Conventionally, the backing member 10' is made of glass-fiber-reinforced epoxy resin having a glass transition point of about 120°–130° C. Further, the backing member is attached to the connector board 4' by a layer of thermoplastic adhesive such as acrylic adhesive with a thickness of about 50 micrometers.

According to the arrangement described above, the backing member 10' has a glass transition point of about 120°–130° C. However, the backing member is often subjected to a high operating temperature of about 150° or more because the heat generated by the heating resistor 6' is transmitted to the backing member through the metallic support plate and because the heat of the other printer components is additionally applied to the backing member. As a result, the backing member 10' softens above its glass transition point and therefore reduces in thickness under the pressure applied by the screws 12, thereby making the screws 12 loose. Further, the thermoplastic adhesive layer between the connector board 4' and the backing member 10' also softens under a high operating temperature, additionally causing loosening of the screws.

When the screws 12' become loose, the connector board 4' together with the backing member 10' may deviate positionally relative to the head substrate 3'. As a result, the electrical contact between the connection terminals 8' of the head substrate and those of the connector board becomes improper (e.g. shorting). Further, the marginal portion **4*a'*** of the connector board may be lifted off the head substrate, thereby resulting in complete electrical disconnection.

SUMMARY OF THE INVENTION

It is, therefore, an object of the present invention to provide a thermal printhead which is capable of preventing a positional deviation of a flexible connector board relative to a head substrate, thereby ensuring good electrical contact between these two members.

According to the present invention, there is provided a thermal printhead comprising: a support plate; a head substrate mounted on the support plate; a connector board reinforced by a backing member which rests on the support plate, the connector board having a marginal portion projecting beyond the backing member; and a presser member overlapped on the connector board and pressed by a pressure applying means for pressing the marginal portion of the connector board into contact with the head substrate; wherein the backing member is made of a material having a glass transition point of not less than 150° C.

Typically, the pressure applying means may be in the form of screws. However, the pressure applying means may comprise an elastic clip.

The connector board may be attached to the backing member by a bonding means which comprise a layer of thermosetting adhesive. Due to the thermosetting nature, the adhesive layer is less likely to reduce in thickness even under a high temperature condition, thereby preventing a reduction of the pressing force applied by the pressure applying means.

Alternatively, the bonding means may comprise a thermoplastic adhesive layer having a thickness of not more than 40 micrometers. In this case, the thickness of the adhesive layer reduces under a high temperature condition, but the degree of the thickness reduction can be rendered critically smaller than if the adhesive layer has a thickness of not less than 50 micrometers.

In another embodiment, the pressure applying screws penetrate through the presser member, the connector board and the backing member into engagement with the support plate, and the bonding means has an annular non-adhesion portion immediately around each of the screws. In this case, even if the thickness of the bonding means reduces, the influence of such a thickness reduction can be minimized around the pressure applying screws because no adhesive are initially absent there.

Other objects, features and advantages of the present invention will be fully understood from the following detailed description given with reference to the accompanying drawings.

DETAILED DESCRIPTION OF THE PREFERRED EMBODIMENTS

Figure 1:
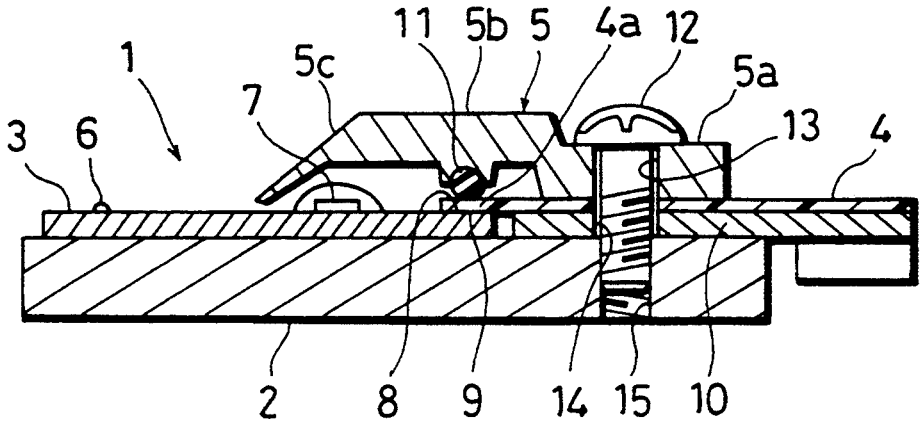
FIG. 1 is a view, in transverse section, showing a thermal printhead according to the present invention.
Figure 7:
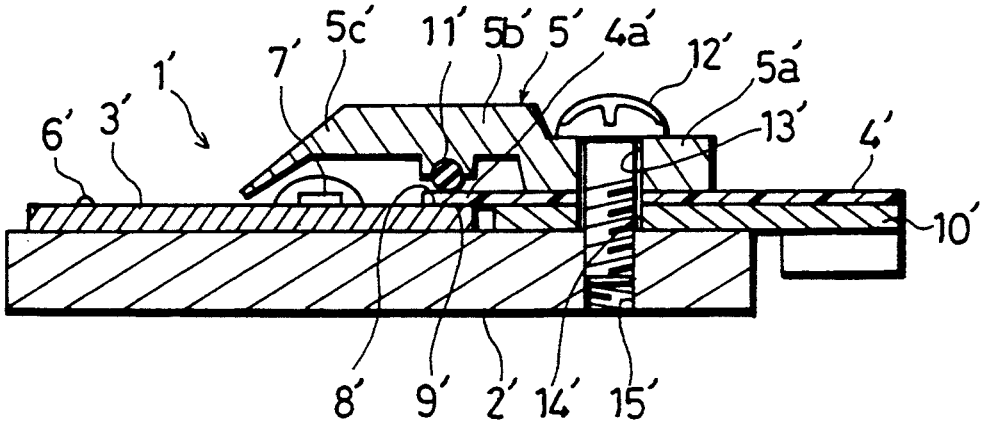
Fig. 7 Prior Art
FIG. 7 is a sectional view similar to FIG. 1 but showing a prior art thermal printhead.

Referring first to FIG. 1, there is illustrated a thermal printhead 1 according to the present invention which is similar in appearance to the prior art printhead shown in FIG. 7. Specifically, the printhead 1 mainly comprises a support plate 2, a head substrate 3, a flexible connector board 4, and a presser member 5.

The support plate 2 is made of a metal such aluminum. In the illustrate embodiment, the support plate is elongate and has a length generally equal to or slightly larger than that of the head substrate 3. The support plate functions to dissipate the heat generated at the head substrate in addition to supporting it.

The head substrate 3, which is made of an insulating material such as ceramic (e.g. alumina), is also elongate and adhesively bonded to the support plate 2. The head substrate is formed with a heating resistor line 6 extending adjacent to and along one longitudinal edge of the substrate. The substrate carries a longitudinal array of drive ICs 7 (only one shown) for selectively actuating divided dot portions of the resistor line 6. The head substrate is further formed with comb-like connection terminals 8 (details not shown) adjacent to the other longitudinal edge of the head substrate, and a wiring conductor pattern (not shown) for connecting between the drive ICs and the connection terminals. The connection terminals 8 may be distributed over the entire length of the head substrate or arranged locally only in a central portion of the head substrate (see U.S. Pat. No. 4,963,886).

The connector board 4 is made of an insulating material such as a polyimide film. The connector board 4 is reinforced by a backing member 10 and has a marginal portion 4*a* projecting beyond the backing member 10 to overlap the head substrate 3. The underside of the marginal portion 4*a* is formed with comb-like connection terminals 9 (details not shown) in corresponding relation to the connection terminals 8 of the head substrate. The connector board 4 may be adhesively bonded to the backing member 10, as more specifically described below.

In the illustrated embodiment, the presser member 5, which may be made of a metal such as aluminum, has an anchoring base portion 5*a*, an intermediate presser portion 5*b*, and a cover portion 5*c*. The anchoring portion 5*a* is fixed on the connector board 4 by means of screws 12 (only one shown), as more specifically described below. The presser portion 5*b* is provided with an elastic rod 11 made of rubber for example for pressing the marginal portion 4*a* of the connector board 4 into intimate contact with the head substrate 3, thereby establishing electrical connection between the two kinds of connection terminals 8, 9. The cover portion 5*c* is located above the array of drive ICs 7 for protection. The cover portion 5*c* may be omitted if the array of drive ICs is enclosed in a package which is made of a relatively hard resin.

For enabling the mounting of the presser member 5, the anchoring base portion 5*a* is formed with perforations 13 (only one shown) for allowing penetration of the respective screws 12. Similarly, the connector board 4 together with its backing member 10 is also formed with perforations 14 in corresponding relation to the respective perforations 13 of the presser member 5. Further, the support plate 2 is formed with threaded holes 14 for engagement with the respective screws 12.

According to the present invention, the backing member 10 is made of a material which has a glass transition point of not less than 150° C. Examples of such a material include fiber-reinforced epoxy resin (with a higher content of reinforcing glass fibers for example), fiber-reinforced BT (bismaleimidotriazine) resin, fiber-reinforced polyimide resin (either modified or non-modified), and ceramic such as alumina. Examples of reinforcing fibers include glass fibers or carbon fibers in a cloth form or other form. The content or proportion of the reinforcing fibers relative to the resin matrix is so determined, depending on the kind of the resin matrix, as to realize the required minimum glass transition point of 150° C.

Conventionally, a backing member for a connector board is typically made of epoxy resin reinforced by a lower content of glass fibers. Thus, the conventional backing member has a glass transition point of 120°–130° C., as already described.

According to the present invention, the backing member 10 may be made of epoxy resin reinforced by inclusion of glass fibers. However, the kind of epoxy resin and/or the content of the reinforcing glass fibers should be determined to achieve a glass transition point of not less than 150° C. For instance, polyfunctional epoxy resin may be used to increase the glass transition point. Alternatively or additionally, the reinforcing glass fibers may be included in a cloth form to increase the fiber content (hence, the glass transition point).

According to the present invention, the backing member 10 having a glass transition point of not less than 150° C. is less likely to reduce in thickness under the compressive force applied by the screws 12 even if the backing member 10 is subjected to a high operating temperature. Thus, the screws 12 are prevented from loosening during the operation, and the flexible connector board 4 is prevented from positionally deviating relative to the head substrate 3. As a result, it is possible to ensure good electrical contact between the two kinds of connection terminals 8, 9.

Figure 2:
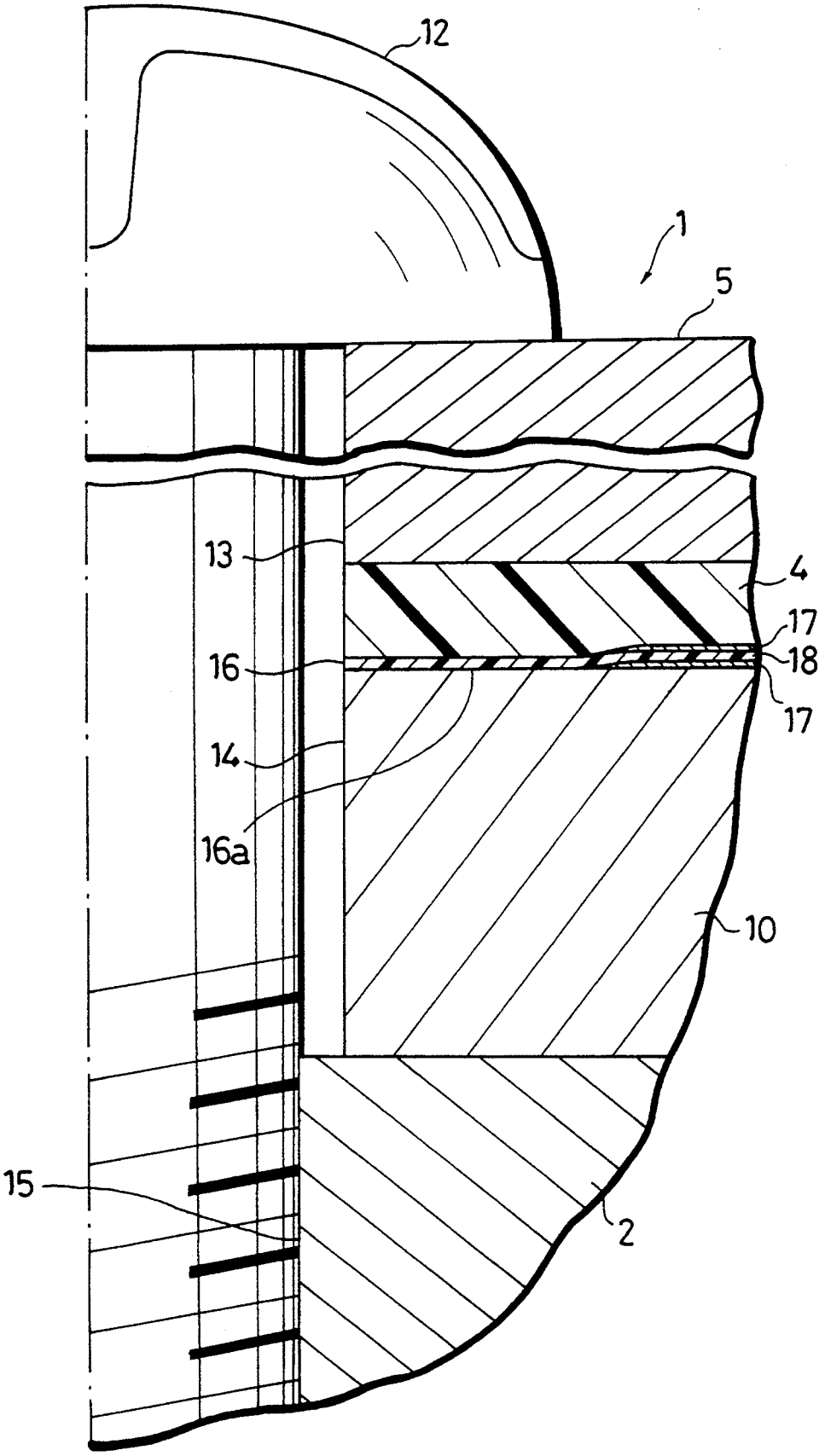
FIG. 2 is an enlarged sectional view showing a principal portion of the same printhead.

As shown in FIG. 2, the backing member 10 is preferably attached to the flexible connector board 4 by a bonding means 16 which is designed to prevent or reduce loosening of the screws 12 during a high temperature operation. More specifically, the bonding means 16 includes a thermally stable core film 18 having both surfaces provided with adhesive layers 17 for adhesion to the connector board 4 and the backing member 10. However, the bonding means 16 has an annular non-adhesion portion 16*a* immediately around each perforation 14 of the backing member 10. Obviously, the core film 18 alone is present at the non-adhesion portion. The non-adhesion portion has an outer diameter which is equal to or slightly larger than the diameter of the corresponding screw head 12.

The adhesive layers 17 may be made of a thermoplastic adhesive such as acrylic adhesive. In this case, the thickness of the bonding means 16 may reduce at a high operating temperature due to the thermoplastic nature of the adhesive layers 17. However, since the thermally stable core film 18 alone is present at the non-adhesion portion 16*a* where the compressive tightening force of the screw 12 is most strongly applied. Thus, the thickness reduction of the bonding means 16 is minimized at the non-adhesion portion 16*a*, consequently preventing or reducing loosening or slackening of the screw 12.

Alternatively, the bonding means 16 may comprise a single adhesive layer which is removed in an annular form immediately around each perforation 14 of the backing member 10 to provide a non-adhesion portion 16*a*.

Further, instead of providing a non-adhesion portion 16*a*, the bonding means 16 may comprise a single layer of thermosetting adhesive entirely covering the bonding surfaces of the connector board 4 and backing member 10. Examples of thermosetting adhesive include alkyl phenol and allyl phenol. The thermosetting adhesive layer may be thermally curable at a temperature of not less than 120° C., preferably not less than 170° C. Obviously, the thermosetting adhesive layer will not soften even upon a temperature increase, thereby preventing the screws 12 from loosening during operation.

Further, instead of providing a non-adhesion portion and using a thermosetting adhesive layer, the bonding means 16 may comprise a single layer of thermoplastic adhesive having a small thickness of not more than 40 micrometers and entirely covering the bonding surfaces of the connector board 4 and backing member 10. When the initial thickness of the thermoplastic adhesive layer is set small, the layer thickness reduces to a smaller degree even if the operating temperature rises to the softening temperature of the thermoplastic adhesive layer, thereby preventing or reducing loosening of the screws 12 during operation.

Now, several examples are given below to show the advantages of the present invention. In the following examples, the same reference numerals as used in FIGS. 1 and 2 are also used to designate corresponding parts of prior art or comparative thermal printheads for convenience of explanation.

EXAMPLE 1

In Example 1, two thermal printheads 1 were prepared which respectively incorporated two different backing member 10. One of the backing member was made of glass-fiber-reinforced epoxy resin having a glass transition point of 150° C., whereas the other backing member was made of glass-fiber-reinforced epoxy resin having a glass transition point of 120° C. Thus, one of the two thermal printheads belongs to the present invention while the other printhead belongs to the prior art.

In assembly of each thermal printhead 1, no adhesive layer was interposed between the connector board 4 and the backing member 10 to ensure that the loosening of the screws 12 occurs only due to a thickness reduction of the backing member 10 itself. In Example 1, the initial tightening torque of the respective screws was 7.5 kgf-cm at room temperature, and the thickness of the backing member 10 was 1 mm.

For determining the thermal loosening of each screw 12, each of the two printheads (the invention and the prior art) was placed successively in ovens held at 60° C., 90° C., 120° C. and 150° C., respectively. After holding for an hour, the printhead was taken out from each oven, and the loosening torque of the screw was measured. The loosening torque is the torque at which the screw starts turning in the loosening direction.

Figure 3:
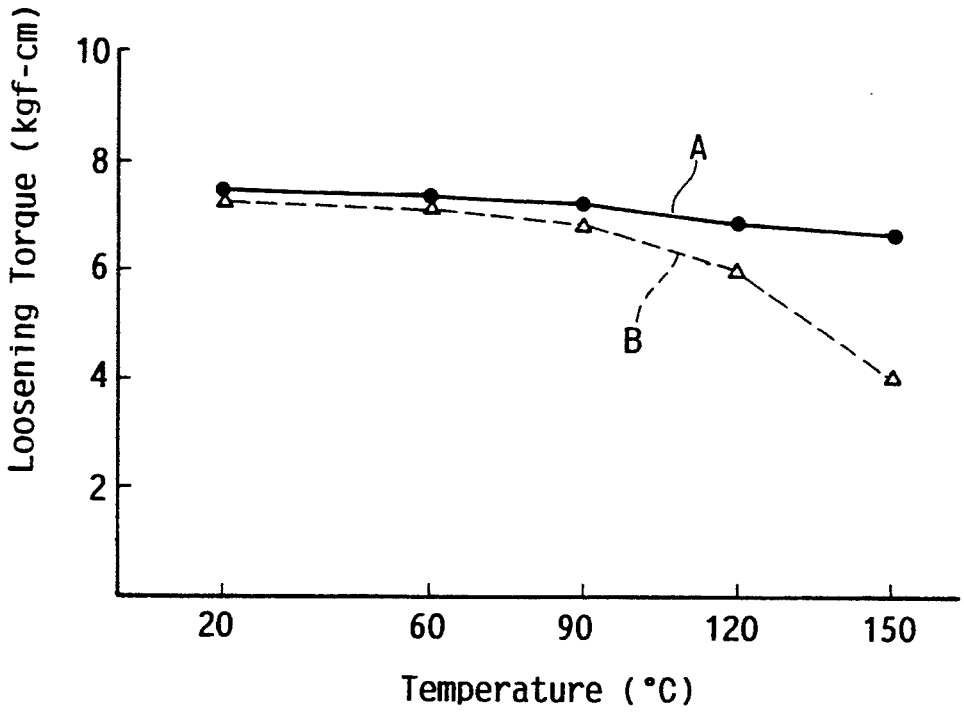
FIGS. 3 through 6 are graphs showing variations in the loosening torque of a screw for various embodiments of the present invention in comparison with the prior art.

The graph shown in FIG. 3 represents variations of the loosening torque with respect to the two different printheads (the invention and the prior art) as the temperature increases. In FIG. 3, the curve A indicates the loosening torque variation for the printhead of the present invention, whereas the other curve B indicates the loosening torque variation for the prior art printhead.

As is clearly appreciated from FIG. 3, in the printhead according to the present invention, each of the screws 12 loosens only to a small extent even after heating at 150° C., as indicated by the curve A. On the other hand, in the prior art printhead, each of the screws 12 loosens to a high degree after heating at 120° C., particularly at 150° C., as indicated by the curve B.

From Example 1, it is concluded that the problem of screw loosening at high temperatures can be effectively reduced by using a backing member which is made of a material having a glass transition point of not less than 150° C.

EXAMPLE 2

In Example 2, two thermal printheads 1 were assembled which respectively incorporated two different backing member 10. One of the backing member was made of alumina (therefore having a glass transition point of not less than 150° C.), whereas the other backing member was made of glass-fiber-reinforced epoxy resin having a glass transition point of 120° C.

In assembly of the thermal printhead 1 (incorporating the alumina backing member) according to the present invention, a bonding means 16 similar to that shown in FIG. 2 was interposed between the connector board 4 and the backing member 10. The bonding means 16 had a thickness of 50 micrometers. The initial tightening torque of the respective screws 12 was 7.5 kgf-cm at room temperature, and the thickness of the backing member 10 was 1 mm.

In assembly of the prior art printhead, on the other hand, a different bonding means comprising only a single layer of acrylic adhesive (an example of conventional thermoplastic adhesive) was interposed between the connector board 4 and the backing member 10. The bonding means had a thickness of 50 micrometers. The initial tightening torque of the respective screws 12 was 7.5 kgf-cm at room temperature, and the thickness of the backing member 10 was 1 mm.

For determining the thermal loosening of each screw 12, each of the two printheads (the invention and the prior art) was placed successively in ovens held at 60° C., 90° C., 120° C. and 150° C., respectively. After holding for an hour, the printhead was taken out from each oven, and the loosening torque of the screw was measured.

Figure 4:
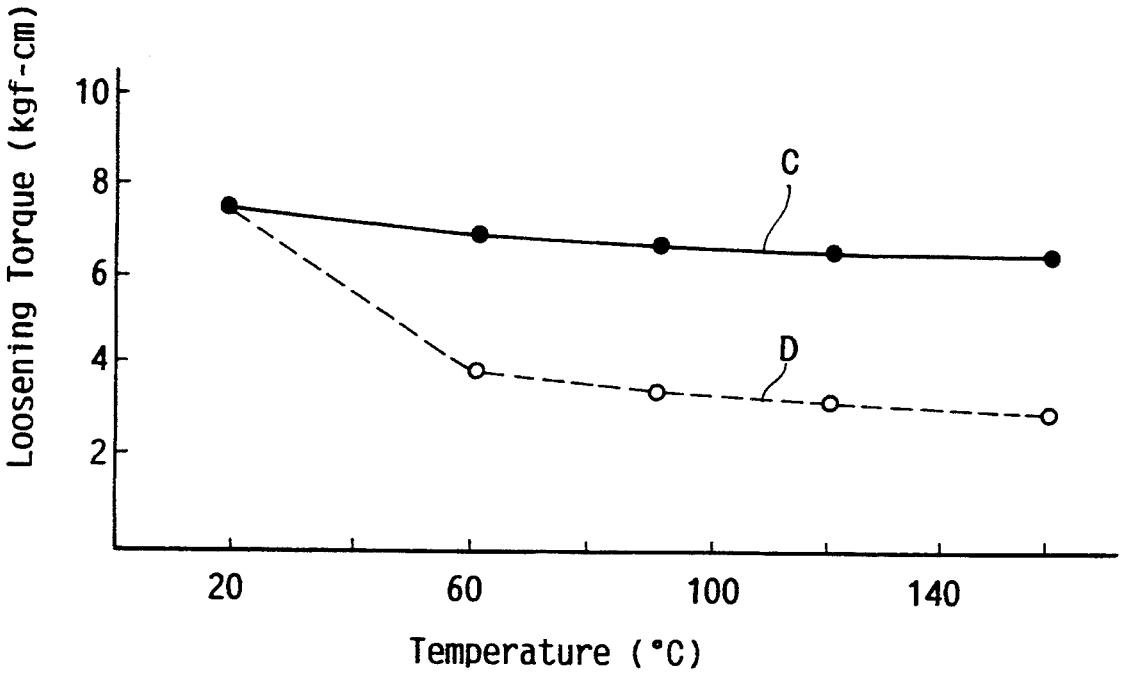

The graph shown in FIG. 4 represents variations of the loosening torque with respect to the two different printheads (the invention and the prior art) as the temperature increases. In FIG. 4, the curve C indicates the loosening torque variation for the printhead of the present invention, whereas the other curve D indicates the loosening torque variation for the prior art printhead.

As is clearly appreciated from FIG. 4, in the printhead according to the present invention, each of the screws 12 loosens only to a small extent even after heating at 150° C., as indicated by the curve C. On the other hand, in the prior art printhead, each of the screws 12 loosens abruptly to a great degree after heating at 60° C., as indicated by the curve D.

Example 2 teaches two things. First, it teaches that the thickness reduction of the backing member (namely, screw loosening) at high temperatures is effectively restrained if the backing member is made of a material having a glass transition point of not less than 150° C. Secondly, Example 2 also teaches that the bonding means 16 shown in FIG. 2 is effective in preventing the problem of screw loosening which may result from a thickness reduction of the bonding means.

EXAMPLE 3

In Example 3, two thermal printheads 1 were assembled, but both of the printhead similarly incorporated a backing member 10 which was made of glass-fiber-reinforced epoxy resin having a glass transition point of 120° C. (which is a value outside the scope of the present invention). The respective printheads were different from each other only with respect to the bonding means between the connector board 4 and the backing member 10.

Specifically, one of the printheads had a bonding means which comprises a single layer of thermosetting adhesive previously cured at 120° C. The other printhead had a bonding means which comprises a single layer of thermoplastic adhesive (acrylic adhesive). In either case, the thickness of the adhesive layer was 50 micrometers, whereas that of the backing member was 1 mm.

For determining the thermal loosening of each screw 12, each of the two printheads was placed successively in ovens held at 60° C., 90° C., 120° C. and 150° C., respectively. After holding for an hour, the printhead was taken out from each oven, and the loosening torque of the screw was measured.

Figure 5:
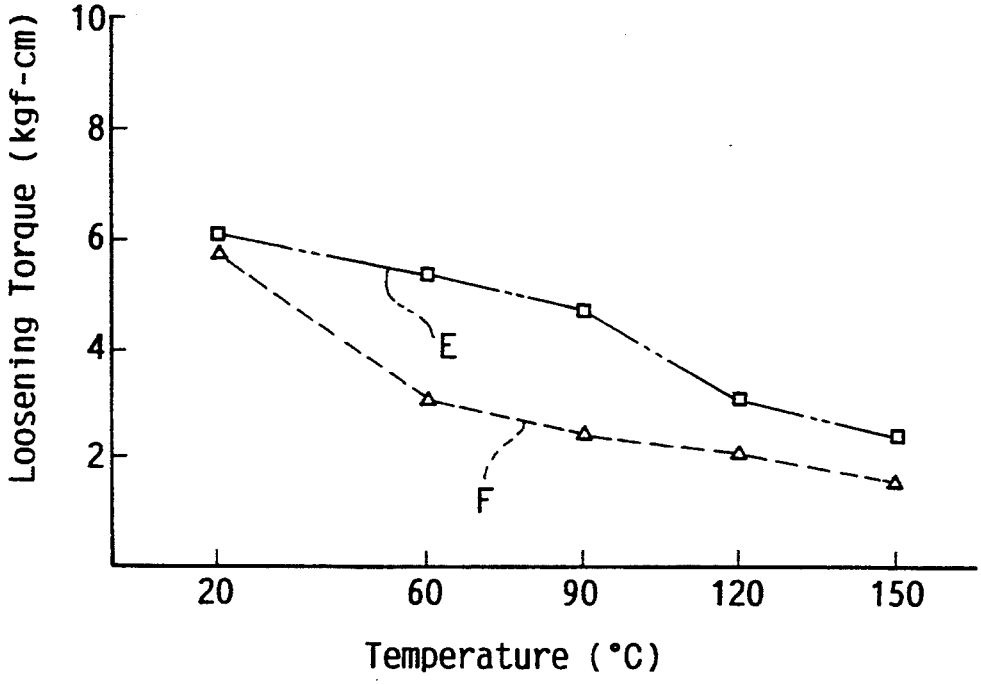

The graph shown in FIG. 5 represents variations of the loosening torque with respect to the two different printheads as the temperature increases. In FIG. 5, the curve E indicates the loosening torque variation for the printhead utilizing the thermosetting adhesive, whereas the other curve F indicates the loosening torque variation for the printhead utilizing the thermoplastic adhesive.

FIG. 5 teaches two things. First, it teaches that the thermosetting bonding means provides a better prevention of screw loosening than the thermoplastic bonding means. Secondly, FIG. 5 also teaches that the use of the thermosetting bonding means alone is not sufficient for preventing the screw loosening at high temperatures because the backing member 10 having a glass transition point of 120° C. undergoes a considerable thickness reduction. Note that the curve E shows the loosening torque variation which has resulted from a thickness reduction not only of the thermoplastic bonding means but also of the backing member.

EXAMPLE 4

In Example 4, three different thermal printheads 1 were prepared.

A first one of the printheads incorporated an alumina backing member 10 (thus having a glass transition point of not less than 150° C.) with a thickness of 1 mm. The backing member was attached to the connector board by a bonding means which comprised a single layer of thermoplastic adhesive (acrylic adhesive) with a thickness of 30 micrometers.

A second one of the printheads incorporated an alumina backing member 10 with a thickness of 1 mm. The backing member was attached to the connector board by a bonding means which comprised a single layer of thermoplastic adhesive (acrylic adhesive) with a thickness of 40 micrometers.

A third one of the printheads incorporated a backing member which was made of glass-fiber-reinforced epoxy resin having a glass transition point of 120° C. The thickness of the backing member was 1 mm. The backing member was attached to the connector board by a bonding means which comprised a single layer of thermoplastic adhesive (acrylic adhesive) with a thickness of 50 micrometers.

For determining the thermal loosening of each screw 12, the screw was initially tightened up with a torque of 7.5 kgf-cm, and each of the three printheads was placed in an oven held at 150° C. After holding for an hour, the printhead was taken out from the oven, and the loosening torque of the screw was measured.

Figure 6:
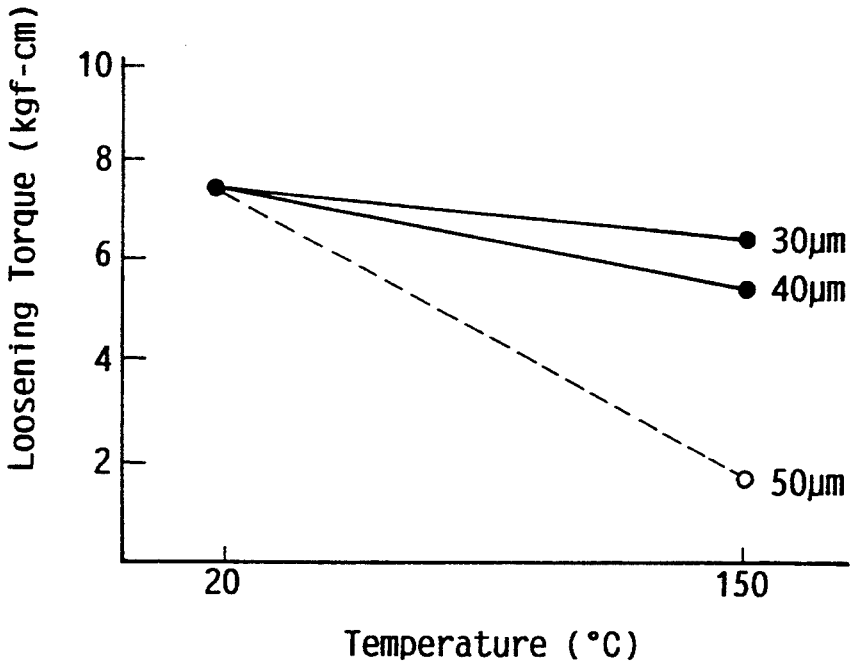

The graph shown in FIG. 6 compares the loosening torque of the respective printheads after heating at 150° C. As clearly appreciated from this graph, the loosening torque reduction in the first and second printheads belonging to the present invention is much smaller than that in the third printhead belonging to the prior art.

The present invention being thus described, it is obvious that the same may be varied in many ways. Such variations are not to be regarded as a departure from the spirit and scope of the invention, and all such modifications as would be obvious to those skilled in the art are intended to be included within the scope of the following claims.

I claim:

1. A thermal printhead comprising:

a support plate;

a head substrate mounted on the support plate;

a connector board reinforced by a backing member which rests on the support plate, the connector board having a marginal portion projecting beyond the backing member; and a presser member overlapped on the connector board and pressed by a pressure applying means for pressing the marginal portion of the connector board into contact with the head substrate;

wherein the backing member is made of a material having a glass transition point of not less than 150° C.

2. The printhead according to claim 1, wherein the connector board is attached to the backing member by a bonding means.

3. The printhead according to claim 2, wherein the bonding means comprises a layer of thermosetting adhesive.

4. The printhead according to claim 2, wherein the bonding means has a thickness of not more than 40 micrometers.

5. The printhead according to claim 2, wherein the pressure applying means comprises screws penetrating through the presser member, the connector board and the backing member into engagement with the support plate, the bonding means having an annular non-adhesion portion immediately around each of the screws.

6. The printhead according to claim 5, wherein the bonding means comprises a core film and two adhesive layers applied to both surfaces of the core film, the annular non-adhesion portion being provided by a portion of the core film not covered by the adhesive layers.

* * * * *